United States Patent [19]

Drane

[11] 3,993,412

[45] Nov. 23, 1976

[54] FLOATING ASPHALT PAVEMENT SYSTEM

[75] Inventor: Terry Lee Drane, Downers Grove, Ill.

[73] Assignee: Koppers Company, Inc., Pittsburgh, Pa.

[22] Filed: Oct. 6, 1975

[21] Appl. No.: 619,567

[52] U.S. Cl. ..... 404/28; 272/3; 404/82

[51] Int. Cl.[2] ..... E01C 21/00

[58] Field of Search ..... 404/17, 27, 28, 82; 272/3, 334

[56] References Cited

UNITED STATES PATENTS

| | | | |
|---|---|---|---|
| 1,650,554 | 11/1927 | Wait | 404/82 |
| 1,699,660 | 1/1929 | Forrest | 404/27 |
| 2,044,498 | 6/1936 | Pearce | 404/28 |
| 3,000,276 | 9/1961 | Foulger | 404/82 |
| 3,557,671 | 1/1971 | Vasiloff | 404/82 |
| 3,850,537 | 11/1974 | Bynmn | 404/17 |

*Primary Examiner*—Henry S. Jaudon
*Attorney, Agent, or Firm*—Herbert J. Zeh, Jr.; Oscar B. Brumback

[57] ABSTRACT

Tennis courts, basketball courts, volleyball courts, all weather running tracks and other similar recreational areas having defects in their surfaces are resurfaced by laying multiple layers of a free floating flexible material over the defective surface and then applying a standard asphalt resurface over the top layer of free floating flexible material. Surfaces prepared in this manner have improved freeze thaw stability, longer life and do not develop reflective cracking.

11 Claims, 1 Drawing Figure

FLOATING ASPHALT PAVEMENT SYSTEM

BACKGROUND OF THE INVENTION

Figure 1:
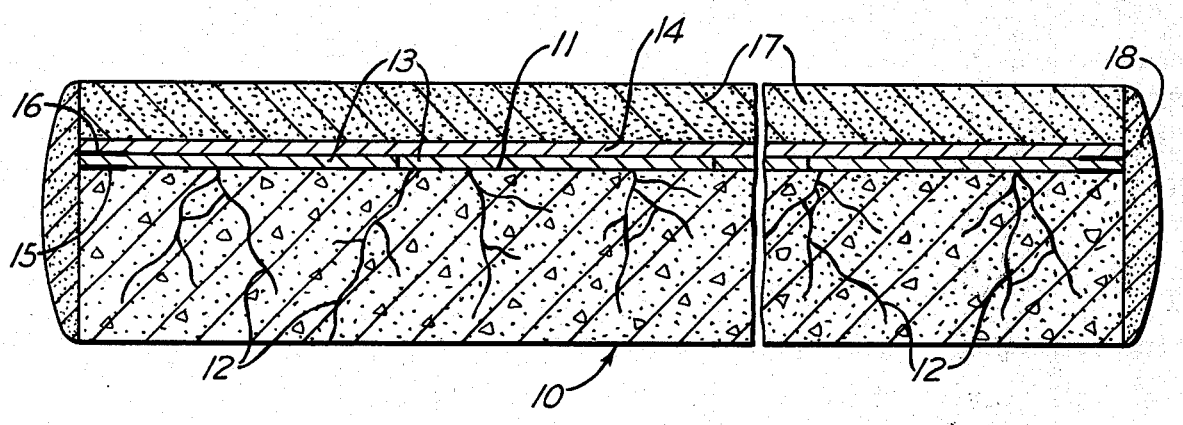

This invention is directed to an improved resurfacing for tennis courts, basketball courts, volleyball courts, all weather running tracks and similar recreational areas. The improvement comprises multiple free floating layers of flexible material interposed between the existing surface and a standard asphalt resurfacing. Surfaces prepared in this manner have improved freeze thaw stability, longer life and do not develop reflective cracking.

It is a well known fact that tennis courts, basketball courts and other recreational surfaces, particularly those made of concrete or asphalt, develop cracks, crevices and the like in their surface after several seasons of play. This is particularly true of outdoor surfaces in areas that have large temperature variations over the course of a year. Once the cracks appear they only get worse until it is difficult or impossible to use the surface. When this happens, it is necessary to remove the old court and replace it with a new court or resurface the old court.

Heretofore, the most common method for resurfacing concrete or asphalt playing surfaces was to clean and prepare the existing surface and then lay a new asphalt surface over the old surface. The new asphalt surface was generally comprised of several inches of asphalt that was applied in several layers over the old surface. This resurfacing resulted in a playing surface that appeared to be new. However, after several months to several years, depending on temperature conditions and usage, these surfaces develop cracks in the same place as in the original surface. This reflective cracking occurs even where the cracks in the original surface were filled prior to resurfacing. Such new asphalt surfaces do not have excellent freeze thaw stability and the reflective cracking is aggrevated by large temperature changes.

Therefore, it is the object of this invention to provide an improved asphalt resurface and method for applying the same.

SUMMARY OF THE INVENTION

I have discovered an improved asphalt resurface for tennis courts, basketball courts, volleyball courts, running tracks and similar recreational surfaces that is freeze thaw stable and overcomes the problem of reflective cracking. This invention also provides a method for applying the improved surface. In accordance with this invention it has been discovered that in resurfacing tennis courts and the like with asphalt an improved surface is obtained by interposing between the original or existing surface to be fixed and the new asphalt surface, multiple layers of a free floating flexible material. Each layer of free floating flexible material is preferably at right angles with the adjacent layer of free floating flexible material and the layers are not affixed to the existing surface or to the other free floating layers. The bottom layer of free floating flexible material is not attached to the existing surface except by a perimeter tack coat and no layer of free floating material is attached to any other layer of free floating material. Consequently, the layers are termed free floating and this term as used herein means that the layers of flexible material are not attached to each other or to the existing surface by mechanical or chemical means except for a perimeter tack coat.

The free floating asphalt paving system of this invention may be better understood with reference to the drawing.

FIG. I is a cross-sectional view of a concrete surface resurfaced in accordance with this invention.

With reference to FIG. I, there is shown a concrete court 10 with a surface 11 having cracks 12 therein. It should be noted that the concrete is cracked but not heaved. The present invention will not work well with a heaved concrete surface. Two layers of free floating flexible material 13 and 14 are located over the existing surface with layer 13 being at a right angle with layer 14. Layer 13 is attached to the existing surface by a perimeter tack coating 15 and layer 14 is attached to layer 13 by a perimeter tack coating 16. A new asphalt surface 17 is placed over the top of the layer 14. An asphalt berm 18 is around the perimeter of the court reaching from the top of the new surface to the bottom of the existing concrete court. The existing court 10 with surface 11 may also be of asphalt so long as it is not heaved.

The improved surface of the invention may be applied as follows. First, all large cracks in the surface to be repaired should be cleaned and filled with a grouting material. The small cracks need not be routed. The entire existing pavement surface should be scraped to remove any ridges or loose aggregate and then cleared to remove all dust, dirt and foreign debris. The perimeter of the pavement surface is then tack coated. The perimeter tack coat will be at least several inches in width. Then a layer of the flexible material is applied to the existing pavement surface in the following manner. The flexible material is applied in rows from one outside edge of the existing pavement to the other edge. Preferably the lift is layed in a line parallel to one of the sides of the existing surface. The next row of flexible material is tack coated to the adjacent row, however, great care must be taken to be sure that no adhesive comes in contact with the existing pavement surface. To the edge of each row of flexible material furthest away from the edge of the pavement where the work began, a coating of adhesive is applied. This coating is kept away from the edge of the flexible material about 1 inch or more and any adhesive that comes in contact with the existing pavement is removed before the next layer of flexible material is applied. The next row of flexible material is overlapped onto the preceeding row, thus forming a continuous layer or lift of flexible material. This procedure is followed across the entire surface until a continuous layer of flexible material covers the existing surface.

Then the outside perimeter of the first layer of flexible material is coated around the perimeter with a suitable adhesive as in the manner described above. A second continuous layer of flexible material is then applied in the same manner above except that the second layer is applied at an angle to the first, preferably a right angle. Care is taken when overlapping the rows of flexible material necessary to form this second layer that no adhesive material is allowed to come in contact with the previous layer. After the second layer is complete, any number of additional layers that are desired may be applied in the same manner.

After the last layer of free floating flexible material is applied, the top layer is covered with a new asphalt surface in the normal manner. For example, the top layer of flexible material is first covered with a suitable adhesive. Then a leveling course of hot plant asphalt mix having large aggregate sizes is applied as a leveling course. On top of the leveling course is rolled a second layer or surface course of hot plant asphalt having small aggregate. Then a berm is formed around the perimeter and extends from the top of the new surface to the bottom of the existing surface. The surface course is then prepared for use by applying multiple coats of suitable paints and sealers.

As mentioned above, the interposing of multiple layers of free floating flexible material between the existing surface and a new asphalt layer comprises the thrust of this invention. The free floating flexible layers increase the freeze thaw stability of the new asphalt surface and prevents reflective cracking. The layers are preferably placed at angles to each other with the most preferred being right angles. However, it is within the scope of this invention to have the layers parallel to each other or any angle between parallel and perpendicular. If the layers of free floating flexible materials are parallel to each other they should not have overlapping seams. The layers of flexible material are preferably placed parallel to the sides of the surface to be repaired. However, it is also within the scope of this invention to place the flexible material in such a manner that it is not parallel to any of the sides of the surface. This is particularly true when the existing surface is not rectangular.

It is an important part of this invention that the layers of flexible material be free floating. The layers are not attached to each other or to the existing surface. It should be noted that the layers are attached to each other and to the existing surface around the perimeter of the surface by a perimeter tack coating. The first layer of flexible material is attached to the existing surface by a perimeter coating of suitable adhesive. Similarly, the other layers of flexible material are attached to each other by a perimeter coating. The perimeter coating generally is less than one foot in width and prevents the new surface from horizontal movement. It has been known in the past to use rigid material to prevent reflective cracking. See, for example, Vasiloff, U.S. Pat. No. 3,557,671 which discloses the use of a rigid fiber glass mat. However, it has not been known to use free floating flexible material.

The flexible material used to form the free floating layers of the present invention may be comprised of any material that is flexible, impervious and capable of being tack coated. Some examples of such material are roofing felt (tar or asphalt impregnated), kraft paper, paper, paper impregnated with asphalt or tar or similar chemicals, fiberglass, impregnated fiberglass, cloth, treated fabrics, etc. The material must be flexible. If the material is not flexible it will not present reflective cracking or obtain the benefits of this invention. The material must also be impervious. If the material is not impervious the new asphalt surface will seep through and bond the layers together into a rigid bonded system and the advantages of the free floating flexible system of the invention will be lost. As mentioned above the flexible material used for the free floating system must be capable of being bonded to the existing surface and other layers of the flexible material. However, this should not present any limitation in the type of useful flexible material since there is available to the art a wide variety of different adhesives. The preferred flexible material is tar impregnated or asphalt impregnated roofing felt. The flexible material can come in rolls, sheets, pads or any other manner. If sheets of the material are used it will be necessary to overlap and tack together several sheets to form a row. When doing this, care should be taken that the tacking adhesive does not come in contact with the existing surface or other layers of material. For ease of application, rolls of the flexible material are preferred.

In keeping within the scope of this invention two or more layers of flexible material may be used. It is necessary that at least two different layers be employed. The maximum number of layers that will be used will depend on the thickness of the material. If very thin material is used more layers will be used. Generally, no more than five layers will be necessary. The more layers that one uses the more labor and time will be expended, thus increasing the cost of the resurfacing. It is preferred to keep the total thickness of the free floating flexible layers to about ⅛ to ½ inches.

It is important that a berm be constructed around the entire perimeter of the playing surface. The berm should reach from the top of the new asphalt surface to the bottom of the existing structure. The berm is necessary to prevent water from going between the free floating layers. It should be noted that under some climate conditions the berm may be omitted, however, it is preferred that a berm be used.

An asphalt surface is placed over the top of the last free floating layer. The top layer of free floating material is coated with a suitable adhesive and a standard asphalt surface is constructed thereon. Any standard asphalt construction may be used. The asphalt surface can be constructed in one or multiple layers. The new surface may also be coated with various paints and/or sealers.

I have resurfaced many playing surfaces in accordance with this invention. The following is an example of the repaving of a tennis court using this invention and is also an example of a preferred embodiment of the invention.

EXAMPLE I

Two asphalt tennis courts positioned side by side located in a large midwestern city and having a surface area of about 1,440 square yards were repaired in accordance with this invention as follows.

All catch basins were adjusted or reconstructed to the correct height and grade to insure proper drainage of the asphaltic pavement after resurfacing. All cracks ¼ inch and larger were routed by mechanical means and cleared to remove all dust, dirt and foreign debris. All cracks smaller than ¼ inch were not routed but were cleaned to remove all dust, dirt and foreign debris. The cleaning was done with compressed air. All the large cracks were filled with a sand filled asphalt mixed by volume with an equal portion of No. 17 stone. All the small cracks were filled with a sand filled asphalt emulsion. The material in both cases was squeege applied and forced into the cracks. All excess material was removed from the pavement surface and the filling in the cracks allowed to cure for 24 hours. The net posts were broken out and adjusted to the proper elevation in relationship to the finished grade of the asphaltic resurfacing and then replaced.

The entire existing pavement surface was scraped to remove any ridges or loose aggregate and then blown clean of any dust, dirt and foreign debris by means of compressed air. The perimeter of the existing surface was tack coated with an asphalt adhesive. The perimeter tack coating was about 6 to 8 inches in width and was applied by brush (rolling is an equivalent method). A layer of 30 pound asphalt saturated roofing felt conforming with ASTM D 226-68 was applied to the existing surface in the following manner. The felt was applied from one outside edge of the existing asphalt pavement to the other edge on a line parallel to the net line. An asphalt adhesive emulsion was used for tacking the felt. Care was used so no tack coat material came in contact with the existing surface. To the edge of each row of felt furthest away from the edge of the existing pavement where the work was started a 12 inch wide tack coat of asphalt adhesive was applied by roller. The tack coat was kept at least 1 inch away from the edge of the felt and any tack coat which came in contact with the existing asphalt pavement was removed prior to the placement of the next row of felt. The next felt was overlapped onto the preceding felt about 1 foot and rolled into the tack coat. This procedure was followed across the entire surface.

The outside perimeter of the first layer of asphalt saturated felt was tack coated as described above. A second layer of the 30 pound asphalt saturated roofing felt was applied in the same manner as described above except the second layer was applied at a right angle to the first, i.e., perpendicular to the net line. Again, care was taken to insure that no tack coat material was allowed to come in contact with the previous layer of asphalt saturated felt during the installation of the second layer. A prime coat of dilute cationic asphalt emulsion was spray applied to the top of the second layer of asphalt saturated felt at a rate of about 0.05 to 0.10 gallons per square yard and allowed to cure for 24 hours.

A leveling course of hot plant mix having a maximum aggregate size of ⅜ inch to ¾ inch in accordance with the specifications of the Asphalt Institute was constructed over the asphalt-saturated felt to a compacted thickness of not less than 1 inch. The hot plant mix was thoroughly compacted by rolling with a powered steel wheel tandem roller weighing between 4 and 6 tons. The surface of the leveling course did not vary from the specified grade more than ¼ inch in 10 feet when measured in any direction.

A surface course of hot plant mix having a maximum aggregate size of ⅜ inch (in accordance with specifications of the Asphalt Institute) was constructed over the leveling course to a compacted thickness of not less than one inch. The surface course was placed over the leveling course so that the paving seams of the two courses were not directly in line with each other. The surface course was rolled as described above and did not vary by ⅛ inch in 10 feet. A hot asphalt berm was constructed around the outside perimeter to prevent moisture from penetrating between the free floating felt system.

A playing surface was then constructed over the surface course as follows. The entire surface was flooded with water and any depressions holding ⅛ inch or deeper was filled and leveled with a sand filled asphalt emulsion. Then the entire surface was thoroughly cleared by compressed air and a coat of sand filled asphalt emulsion was squeezed over the entire surface at a rate of not less than 0.10 gallons per square yard. Then two coats of an acrylic color coating was applied over the entire surface in accordance with the manufacturers directions (not less than 0.08 gallons per square yard). One coat was applied lengthwise and the other crosswise. A final finish coat of an acrylic coating was then applied in accordance with the manufactures directions. Finally, the lines were painted on in accordance with USTA specifications and the entire surface coated with an acrylic sealer.

I claim:

1. An asphalt resurfaced recreational area comprising an existing surface, multiple layers of a free floating flexible material on top of the existing surface, said free floating layers being affixed to the existing surface and each other by a perimeter tacking, and a new asphalt surface on top of the free floating layers.

2. An asphalt resurfaced recreational area as in claim 1 further including a berm around the perimeter of the recreational area extending from the top of the new asphalt surface to the bottom of the existing recreational area.

3. An asphalt resurfaced recreational area as in claim 2 wherein the free floating flexible layers are parallel to the sides of the recreational area.

4. An asphalt resurfaced recreational area as in claim 1 wherein each free floating flexible layer is at a right angle with the adjacent free floating flexible layers.

5. An asphalt resurfaced recreational area as in claim 1 wherein the free floating flexible material is roofing felt.

6. An asphalt resurfaced recreational area comprising an existing surface, multiple layers of roofing felt on top of the existing surface said layers of roofing felt being affixed to the existing surface and each other by a perimeter tacking, each layer of said roofing felt being at right angles with the adjacent layers and being parallel to the sides of the recreational area, a new asphalt surface on top of the layers of roofing felt and a berm around the perimeter of the recreational area extending from the top of the new asphalt surface to the bottom of the existing recreational area.

7. In a method for resurfacing a recreational area with asphalt comprising cleaning and preparing the existing surface and laying a new asphalt surface over the existing surface; the improvement comprising laying multiple layers of a free floating flexible material over the existing surface before the new asphalt surface is applied said free floating layers being attached to the existing surface and each other by a perimeter tack coating.

8. A method as in claim 7 further including constructing a berm around the perimeter of the recreational area extending from the top of the new surface to the bottom of the existing surface.

9. A method as in claim 8 wherein the free floating flexible material is roofing felt.

10. A method as in claim 8 wherein the free floating flexible layers are at right angles with each other.

11. A method as in claim 10 wherein the free floating flexible material is roofing felt.

* * * * *